US006358163B1

(12) United States Patent
Tanner

(10) Patent No.: US 6,358,163 B1
(45) Date of Patent: Mar. 19, 2002

(54) DURABLE BATTING TEE FOR BASEBALL

(76) Inventor: Joe H. Tanner, 3918 Meadow Creek La., Sarasota, FL (US) 34233

( * ) Notice: Subject to any disclaimer, the term of this patent is extended or adjusted under 35 U.S.C. 154(b) by 0 days.

(21) Appl. No.: 09/728,699

(22) Filed: Dec. 5, 2000

(51) Int. Cl.[7] ..... A63B 69/00

(52) U.S. Cl. ..... 473/417; 473/422; 473/508; 248/94; 124/5

(58) Field of Search ..... 248/94, 95; 473/417, 473/419, 420, 422, 423, 454, 508, 511, 386, 387; 124/5, 16

(56) References Cited

U.S. PATENT DOCUMENTS 1,088,633 A * 2/1914 Boyer ..... 248/95
1,593,577 A * 7/1926 Kaiser ..... 473/511
2,964,316 A * 12/1960 Rose ..... 473/454
3,039,770 A * 6/1962 Ferretti ..... 473/454
3,877,697 A * 4/1975 Lersch ..... 473/417
3,883,138 A * 5/1975 Chorey ..... 473/417
4,938,478 A * 7/1990 Lay ..... 473/423
4,979,741 A * 12/1990 Butcher ..... 473/417
5,472,025 A * 12/1995 Conrad et al. ..... 141/332
5,580,047 A * 12/1996 Shih et al. ..... 473/417
5,848,945 A * 12/1998 Miller et al. ..... 473/417

* cited by examiner

*Primary Examiner*—Paul T. Sewell
*Assistant Examiner*—Mitra Aryanpour
(74) *Attorney, Agent, or Firm*—Akerman, Senterfitt & Edison, P.A.; Michael C. Cesarano

(57) ABSTRACT

A durable batting tee utilizes an adjustable compression nut to provide a range of adjustable heights for extensible vertical pipes, and an inverted flexible cone atop the vertical pipes upon which a baseball is placed for hitting, such that the compression nut will maintain the rubber cone at a predetermined height, and the flexible cone will maintain its integrity throughout a lifetime of repeated strikes with a baseball bat. The baseplate is dimensioned and weighted to hold the tee upright during normal use, and to permit tipping when subjected to errant swings of a bat.

8 Claims, 12 Drawing Sheets

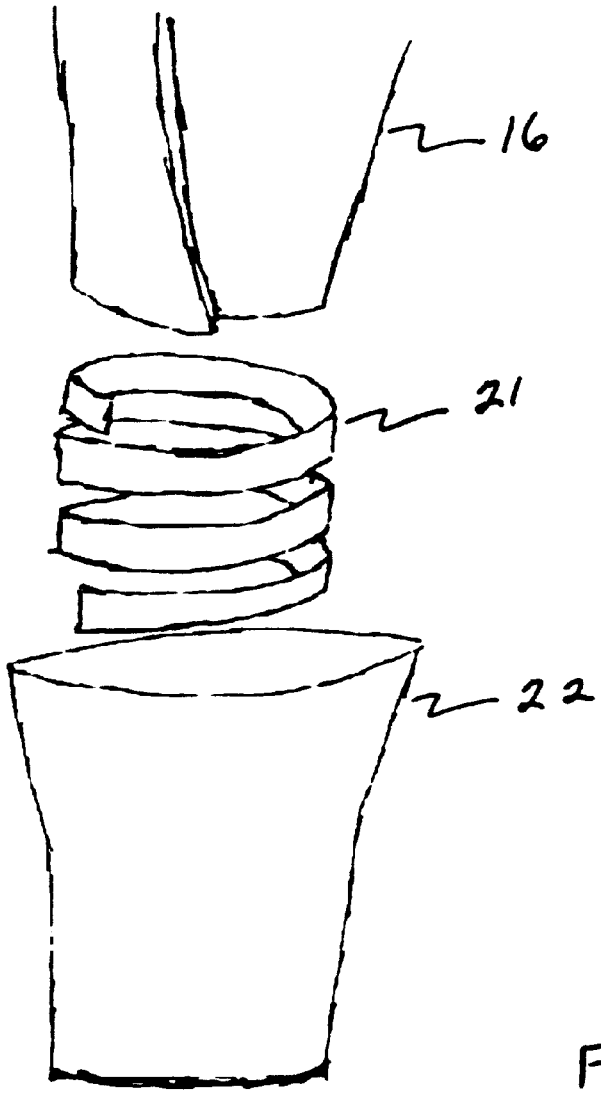
FIG 6
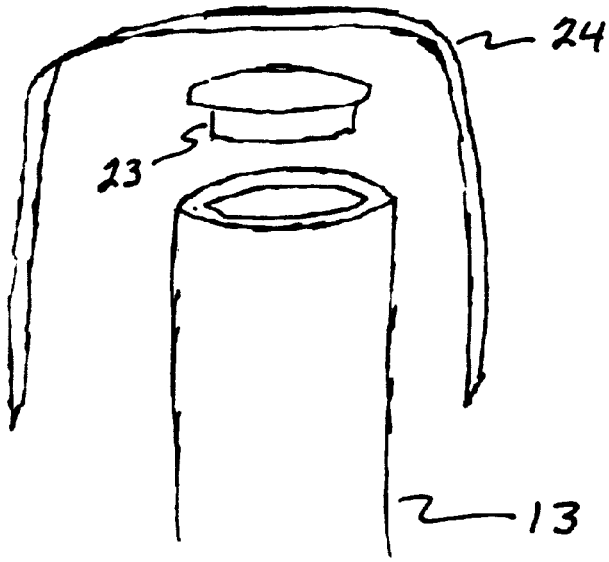

DURABLE BATTING TEE FOR BASEBALL

BACKGROUND

A batting tee is used by baseball players to practice hitting baseballs held at various positions within or near the strike zone. By using a batting tee to practice hitting a stationary ball, players can improve their batting swings and learn to hit balls from various locations within and near the strike zone. Because many players wish to practice hitting balls from locations that are awkward or unfamiliar to them, or from which the player has previously experienced difficulty hitting a ball, it is a common accident for players to strike the batting tee with the bat, rather than hitting the baseball held atop the tee. The result is that batting tees typically suffer tremendous physical abuse throughout their lives.

SUMMARY AND OBJECTS OF THE INVENTION

It is an object of this invention to make a batting tee that will withstand physical abuse throughout its life. It is another object of this invention to use an adjustable compression ring fitting to enable the extensible pipes to be set or maintained at any predetermined height without slippage or unanticipated retraction caused by repeated strikings by a bat. Yet a further object of the invention is to provide a dull or rounded surface to the flexible ball holder to prevent cutting or tearing of the ball holder during use. These and further advantages of this invention will become apparent in the following description of the invention.

BRIEF DESCRIPTION OF THE DRAWINGS

FIG. 6 is an exploded view of the upper portion of the vertical pipe and lower portion of the ball holder showing details of the method of attachment.

DETAILED DESCRIPTION OF THE DRAWINGS AND PREFERRED EMBODIMENTS

Figure 1:
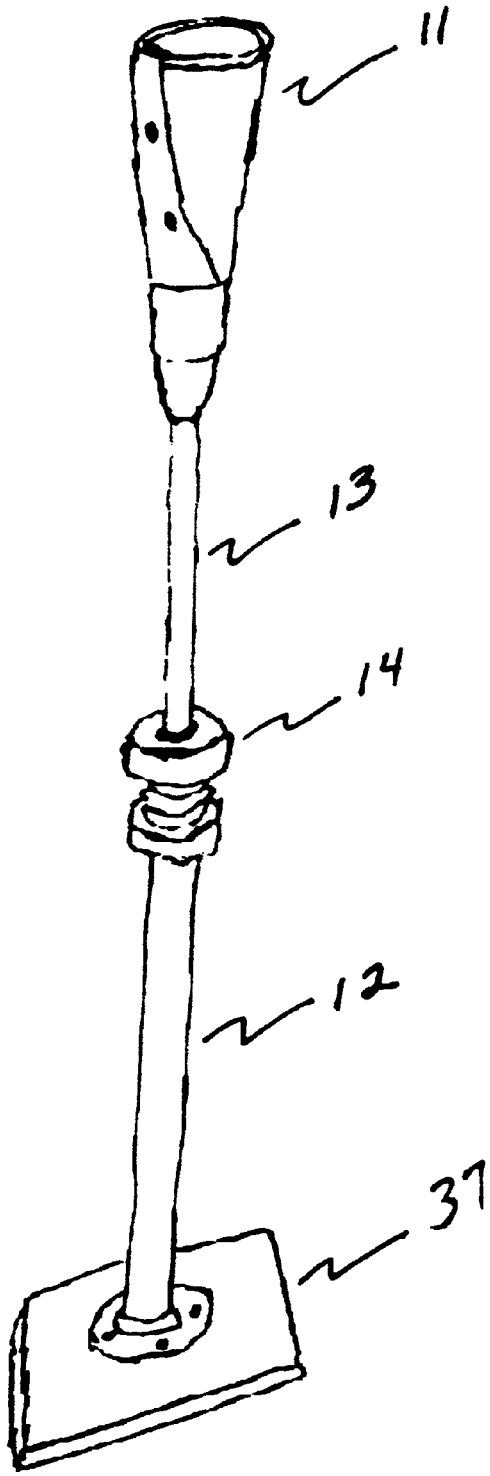
FIG. 1 is a perspective view of the batting tee of this invention having two extensible members.
Figure 2:
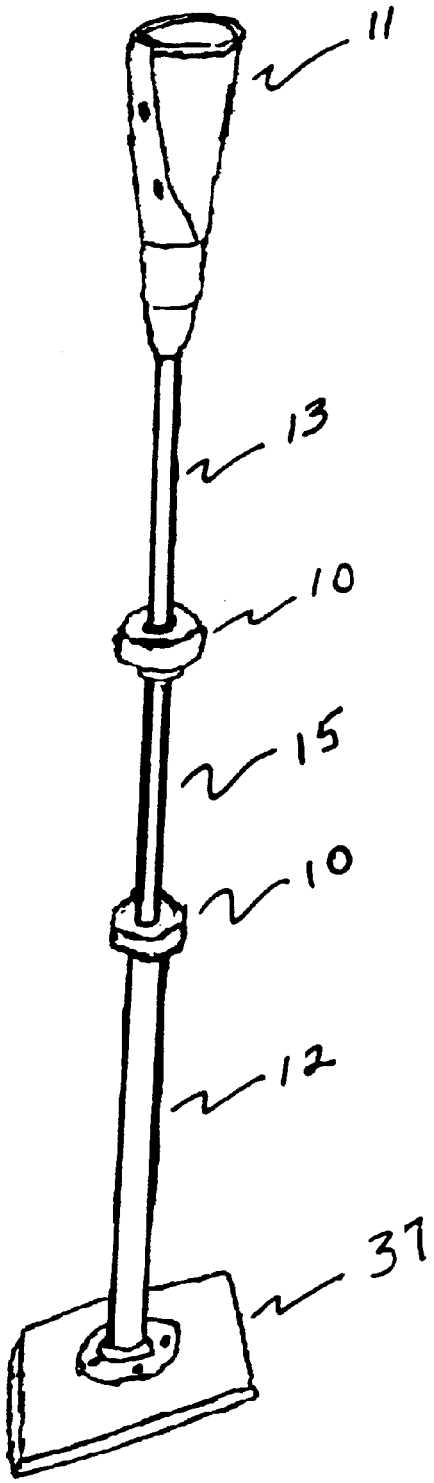
FIG. 2 is a perspective view of an alternative embodiment of the batting tee of this invention having three extensible members.

FIG. 1 depicts a batting tee having a conical ball holder 11, extensible lower and upper pipes 12 and 13 held in position by adjustable compression fitting 14, and attached to a baseplate 37. Compression fitting 14 is a double adjustable fitting shown in greater detail in FIGS. 9 and 10. FIG. 2 shows an alternative embodiment of the batting tee of this invention. In FIG. 2, depicting the preferred embodiment, a middle extensible pipe 15 is shown between upper extensible pipe 13 the lower end of the upper vertical member having a sleeve at its lower extremity, the outer diameter of the sleeve being slightly smaller than the inner diameter of the lower vertical member and lower extensible pipe 12. Three extensible pipes may be used to provide a greater range of height for the ball holder than is possible with a two-extensible member tee. Single adjustable compression fittings 10 are shown securing extensible pipes 12, 13 and 15 in FIG. 2.

Figure 3:
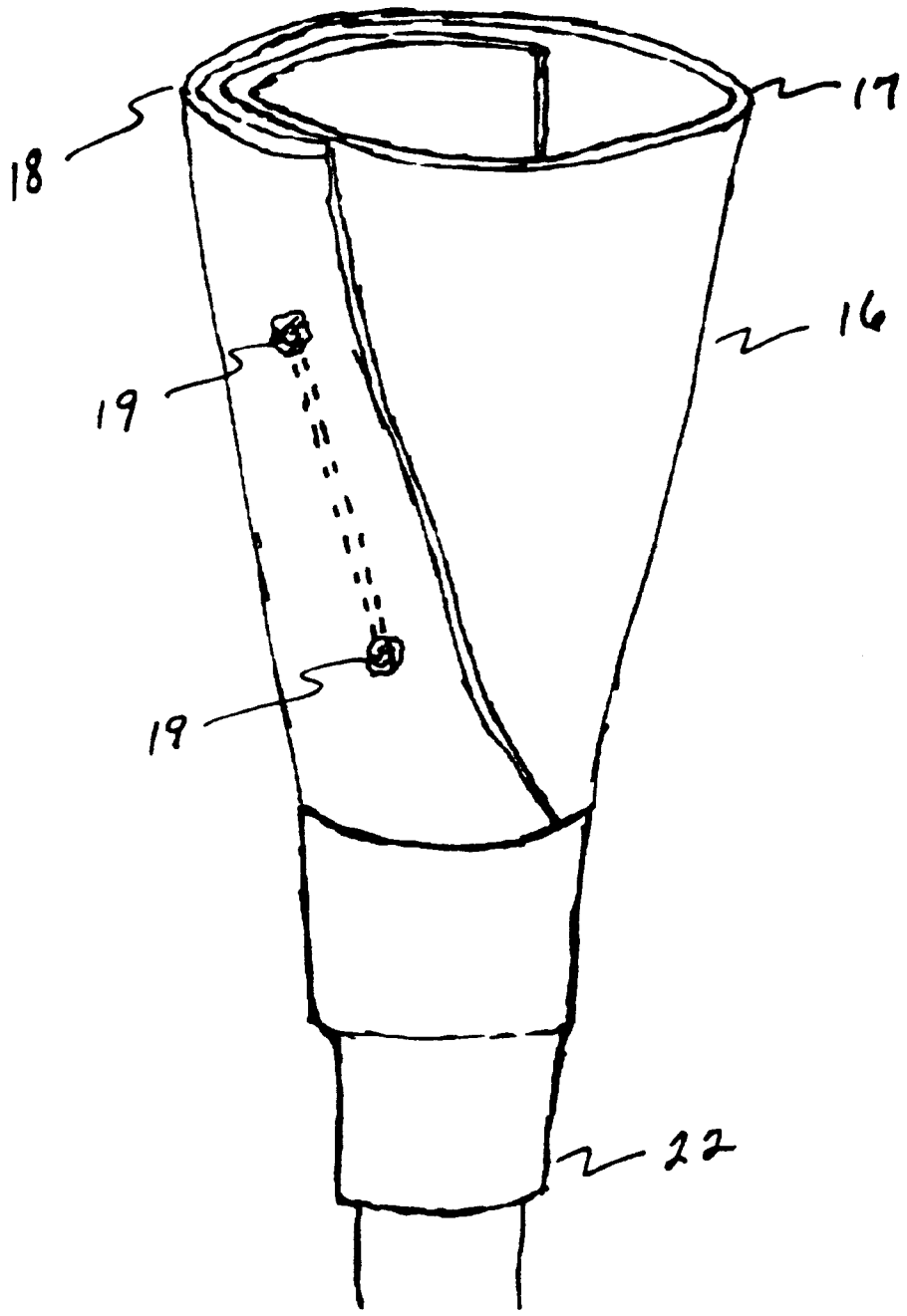
FIG. 3 is a front, perspective view of the ball holder of this invention.
Figure 4:
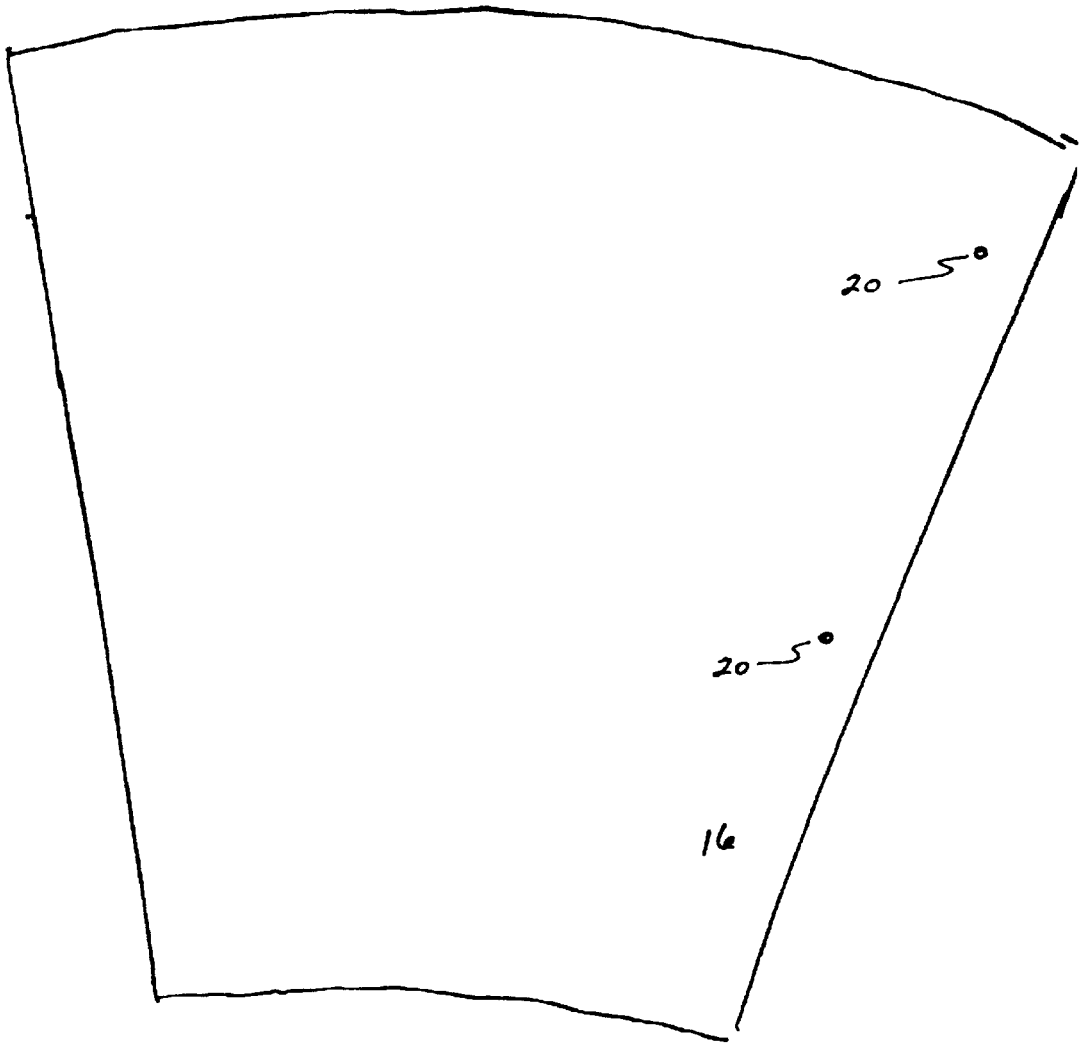
FIG. 4 is a plan view of the shape of flat sheet material used to fabricate the ball holder.

The ball holder is shown is FIG. 3, and is made from a single flexible sheet of material 16, such as rubber, fabric, or some other suitable material or combination of materials. FIG. 4 depicts the flat shape of the sheet material 16 from which the ball holder is fashioned. The material is rolled to form an inverted cone that holds a ball. The cone has a small diameter at the lower end and a larger diameter at the upper end.

In choosing a suitable material for the ball holder, attention must be given to the flexibility and rigidity of the material. When rolled to form the ball holder, the material must exhibit sufficient rigidity to hold a baseball and to return to its frustoconical shape after being hit with a baseball bat, yet be sufficiently collapsible to give way when struck by a baseball bat. Too much rigidity in the ball holder will cause the batting tee to topple when the ball holder is struck by a bat. Rigidity of the ball holder may be enhanced as necessary by increasing the number of wraps or turns used to form the conical ball holder. In the embodiment shown in FIG. 3, the material 16 has been rolled to form a frustocone in which approximately one-half of the conical wall is formed of a single ply 17, and the remaining half consists of overlapped, double ply material 18. Experimentation has shown that suitable flat material has been cut and shaped from the inner tubes of truck tires the frustoconical ball holder having a longitudinal axis of approximately 6" to 8", a lower inner diameter that is slightly larger than the outer diameter of the upper vertical member, and having an upper diameter that is approximately 1½" to 3". This material, when configured as shown in FIG. 3, has been found to provide sufficient rigidity to hold a baseball and to withstand repeated striking by a baseball bat while having sufficient flexibility to collapse when struck by a bat, allowing the bat to continue its motion without toppling the batting tee.

In FIG. 3, the ball holder is held in its rolled, conical shape by a flexible cord 19, preferably made of nylon, that is threaded through eyes 20 bored or punched through a unthreaded. As tied, the cord is approximately ¼" longer than the length it would be if it were tied to fit snugly against the conical surface. The flexible cord permits the ball holder to flex and deform when being hit, yet returns the ball holder to its original shape when external forces are removed. Because the cord is flexible, it is able to withstand repeated poundings from a bat.

Figure 5:
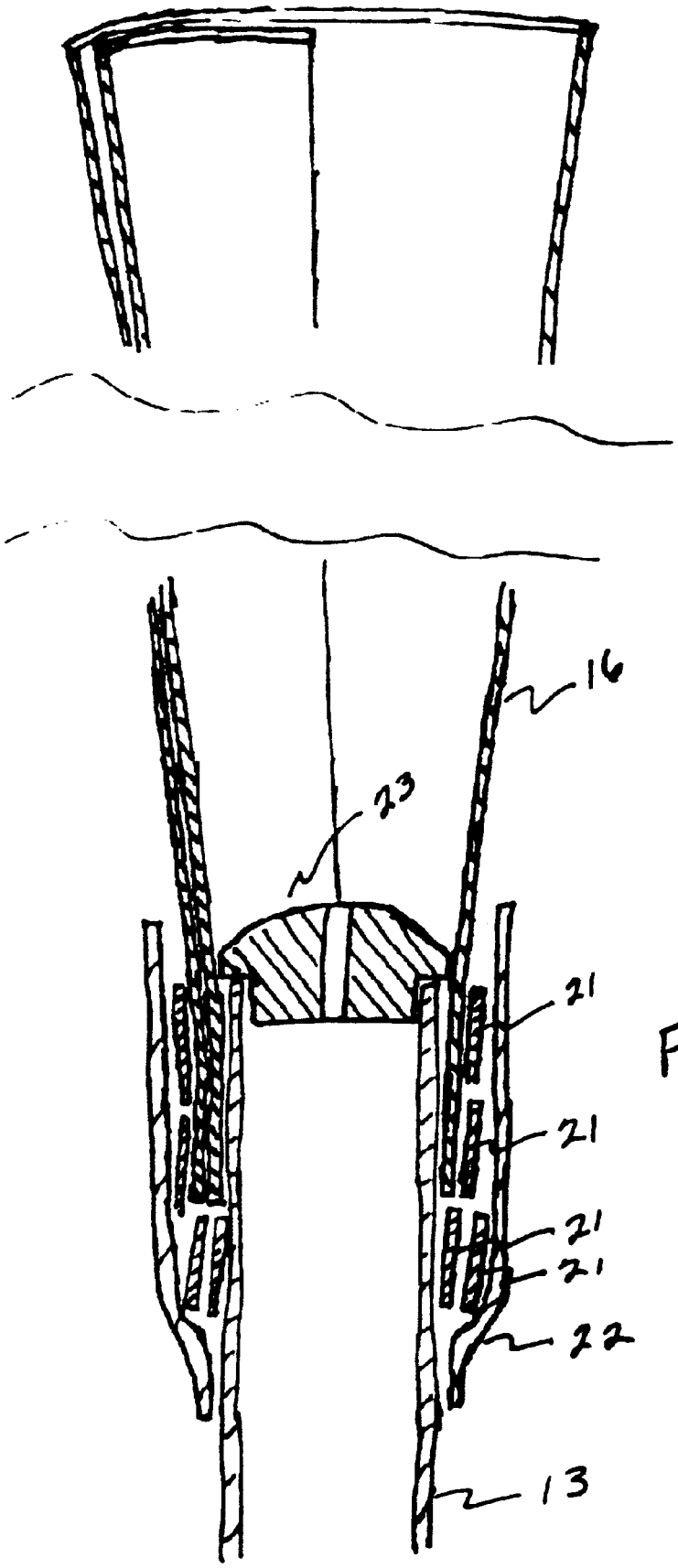
FIG. 5 is a side, cutaway view of the ball holder and upper extensible pipe of this invention.

As shown in FIGS. 5 and 6, the lower, smaller diameter of the conical ball holder is tightly wrapped around the upper end of the vertical, extensible pipe, and is held in place by heavy-duty tape 21 wrapped repeatedly around the lower portion of the conical material 16 and the upper portion of the upper extensible pipe 13. The tape, which may have a nylon backing, is then covered with a flexible sleeve 22, preferably made of rubber, whose unstretched diameter is slightly smaller than the outer diameter of upper pipe 13. The sleeve 22 covers tape 21, keeping it free from the deleterious effects of sun and rain, and further holding the tape against unraveling.

A rubber or nylon grommet or cap 23 may be inserted into the upper end of upper pipe 13 to provide a flexible, rounded surface to the lower portion of the ball holder when flexible material 16 is bent against the top of upper pipe 13. This cap may be held in place with tape, 24. When a bat strikes the lower area of the ball holder, the holder may collapse and be pinched between the bat and the cap 23. Where the cap is rounded, there is less likelihood that the pinching action will split or tear the lower portion of ball holder 11 than if the upper end of upper pipe 13 were left uncovered.

Figure 7:
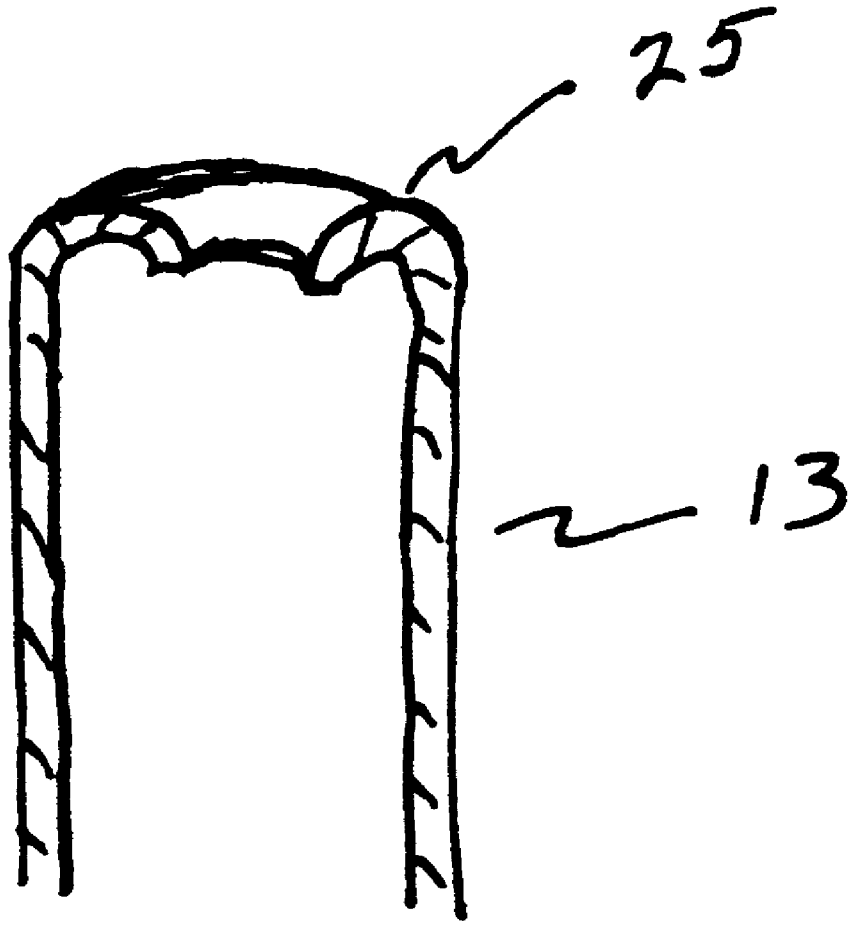
FIG. 7 is a cutaway view of the upper portion of the vertical pipe in an alternative embodiment.

Alternatively, as shown in FIG. 7, the circumferential edge 25 of the upper end of upper pipe 13 may be rounded and turned inward and downwardly to present a rounded surface to the lower portion of the ball holder 11. The rounded surface of the lip of the pipe avoids having a sharp edge adjacent to the innermost rubber sheet forming the ball holder, and resists laceration of the ball holder when struck by a bat.

Figure 8:
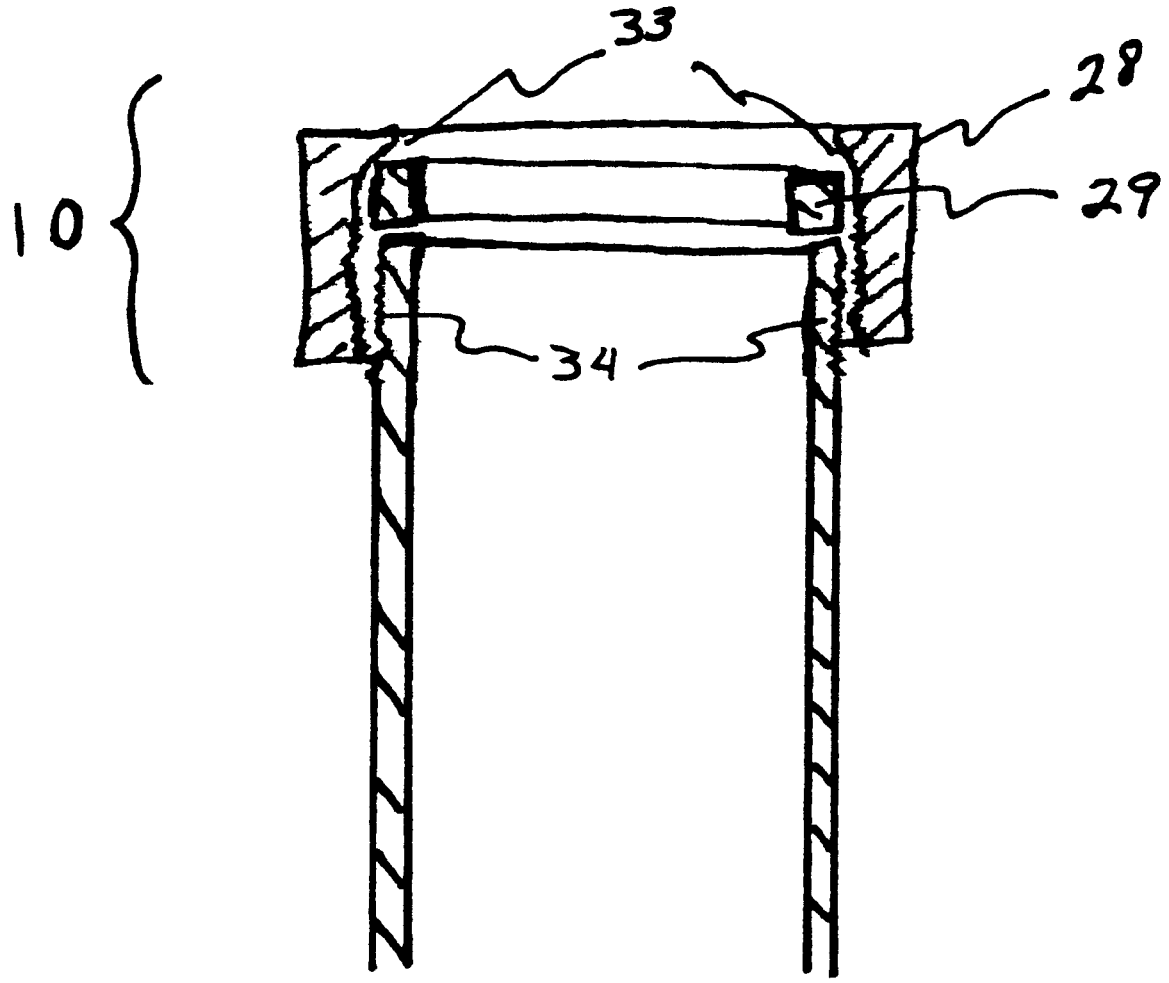
FIG. 8 is a front, cutaway view of an adjustable compression fitting used to connect two extensible vertical pipes.

An adjustable compression fitting 10 is shown in FIG. 8, which is used to join extensible vertical pipes 12, 13, and 15 together in a telescopic arrangement to permit the ball holder to be raised or lowered to any desirable height. Flexible compression washer 29 surrounds an upper extensible pipe (not shown) that fits within the inner diameter of a threaded lower extensible pipe 34. Compression nut 28 has a beveled interior surface 33 that, when tightened down on threaded lower extensible pipe 34 causes compression washer 29 to compress, squeezing the upper pipe and creating sufficient friction between the compressible washer 29 and the upper pipe to prevent the upper pipe from sliding downward into the lower pipe 34. When compression nut 28 is loosened, beveled surface 33 is raised, permitting compression washer 29 to expand, thereby reducing the friction holding the upper pipe and allowing it to be moved to a desired vertical position. The external surface of compression nut 28 may be abraded, roughened, coated with a rubberized surface, or given an irregular shape to assist gripping when the nut is to be tightened or loosened with a sweaty hand or under other conditions of moisture on the outer surface of the compression nut.

Figure 9:
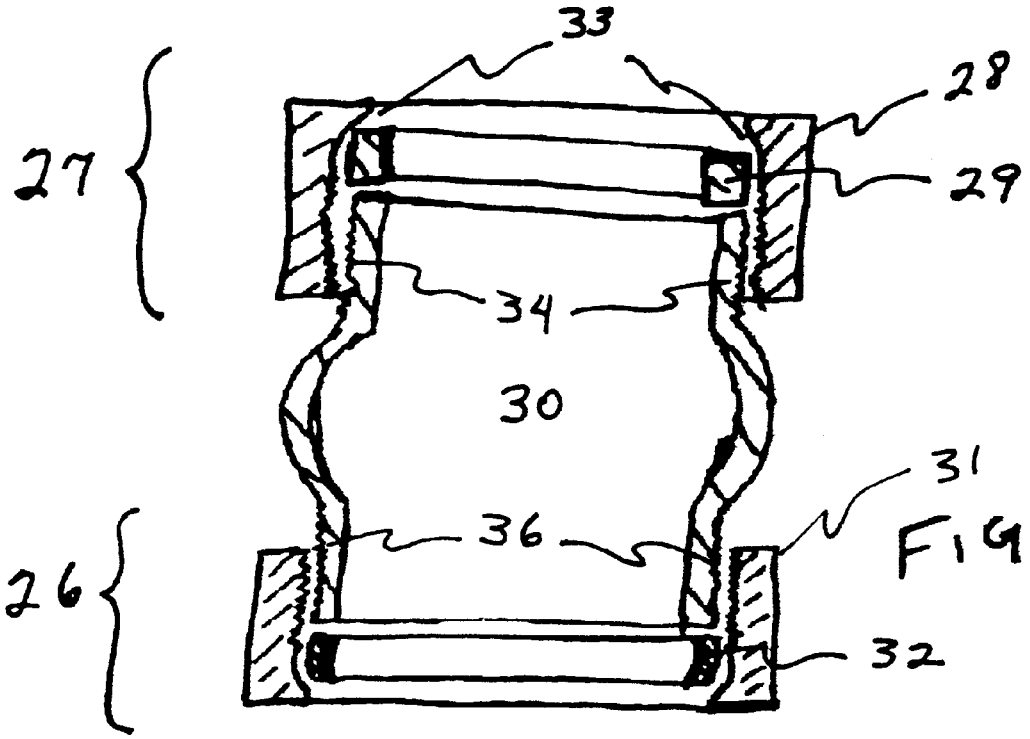
FIG. 9 is a front, cutaway view of a double compression fitting used in an alternative embodiment of the invention.
Figure 10:
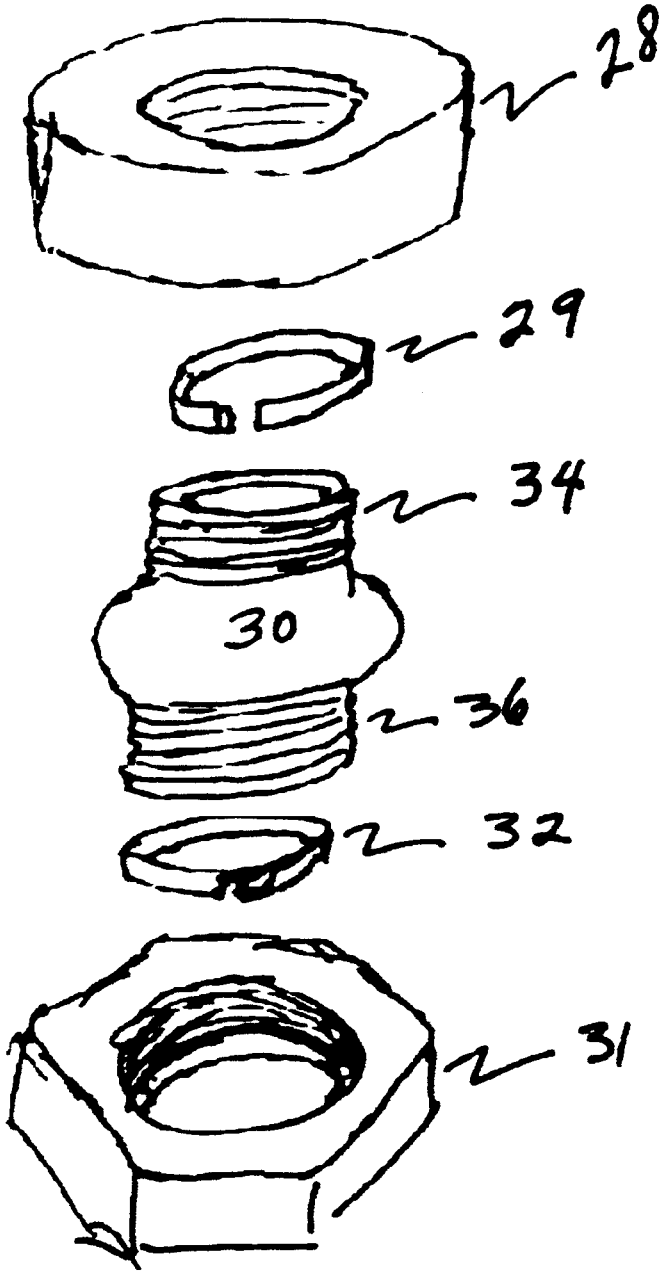
FIG. 10 is an exploded view of the double adjustable compression nut shown in FIG. 9.

In FIGS. 9 and 10, a double adjustable compression fitting is shown, consisting of upper compression fitting 27 and lower compression fitting 26. The compression fitting includes a separately adjustable compression nut and washer at either end having different diameters, the larger diameter fitting 26 holding the upper end of lower extensible member 12 and the smaller diameter fitting 27 holding the upper extensible member 13. When using a double adjustable compression fitting, lower fitting 26 is attached more or less permanently, and it is not intended to slide along lower extensible member 12. Upper fitting 27 is adjustable, and may be tightened or loosened with a turning motion to permit upper extensible member 13 to be moved to a desired vertical position.

As shown in FIG. 9, upper compression nut 28 has an interior bevel 33 near the uppermost end such that, when upper compression nut 28 is threaded down upon the upper, threaded end 34 of assembly body 30, upper compression ring 29 is squeezed tightly around an upper extensible pipe (not shown) to hold the pipe at a desired position. Because this compression fitting is intended to be tightened and loosened when an upper extensible pipe is being adjusted, and many such adjustments will be made during a single practice batting session, upper compression ring 29 may be made of nylon, felt, or some other semi-flexible material that will permit easy sliding of upper extensible member 13 with only slight loosening of upper compression nut 28.

Lower compression nut 31 is similarly constructed, with a lower interior bevel 36 constricting and squeezing lower compression ring 32 against a lower extensible pipe (not shown) when lower compression nut 31 is tightened against the lower threaded end 36 of assembly body 30. However, because this compression fitting is intended to be more or less permanent, lower compression ring 32 may be of metallic or other semi-rigid construction, and is not intended to be easily adjustable during use of the batting tee. It will be understood that the embodiment depicted in FIGS. 9 and 10, provides a maximum of flexibility in construction, assembly, disassembly, repair, and replacement of the various components of the batting tee of this invention, and that other compression fittings known in the art may be substituted as original or replacement parts.

Figure 11:
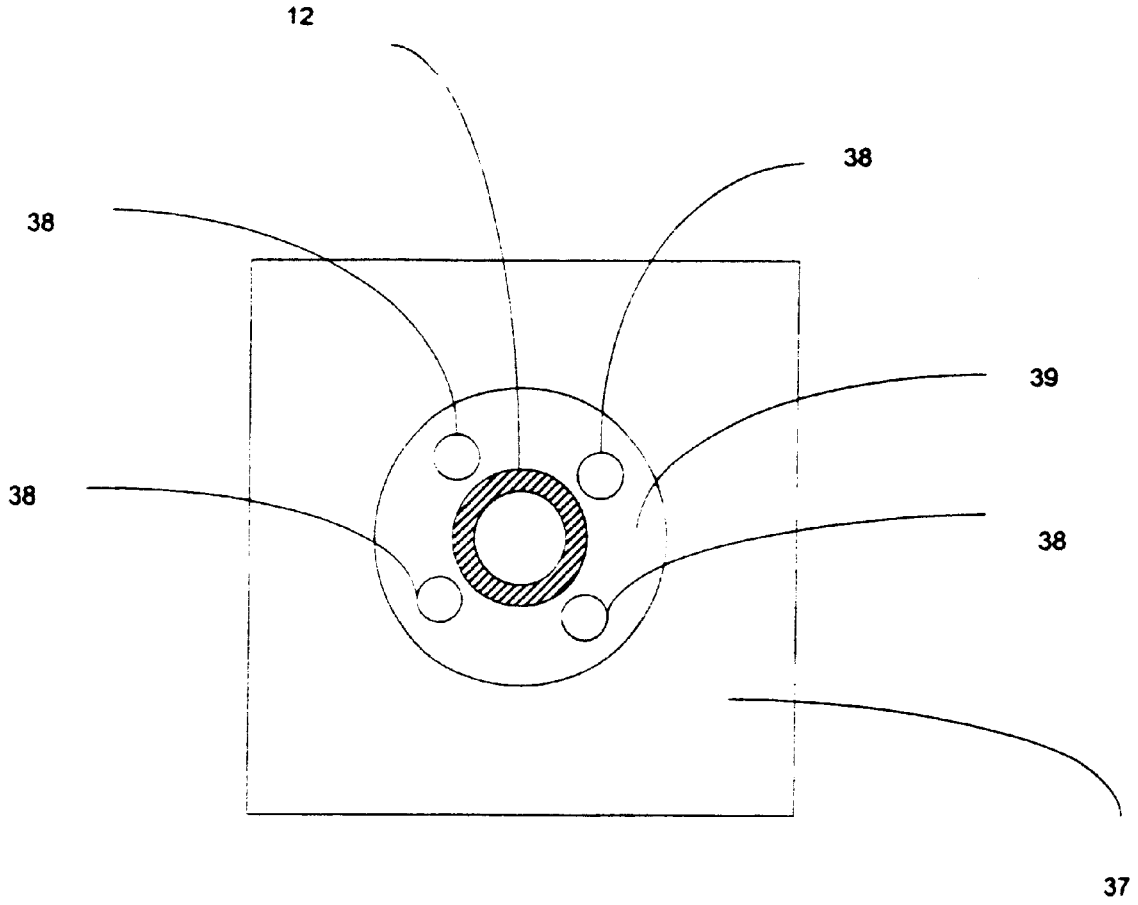
FIG. 11 is a plan view of the baseplate and lower vertical pipe attachment of this invention.
Figure 12:
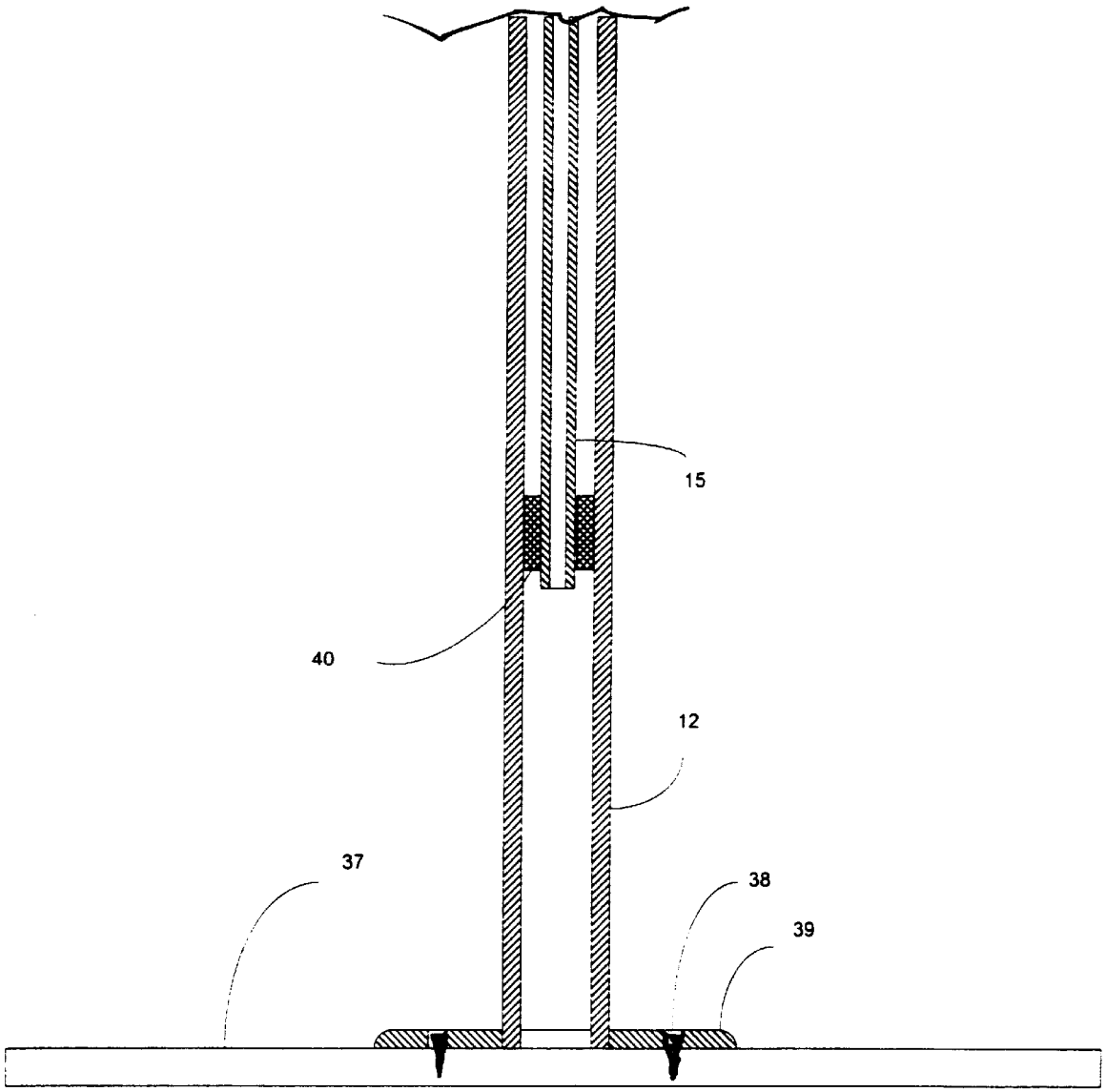
FIG. 12 is a front, cutaway view of the base plate, lower vertical pipe, and the lower extremity of an upper vertical pipe intended to slide concentrically within the lower vertical pipe.

The base of the batting tee of this invention is depicted in FIGS. 11 and 12. FIG. 11 shows a plan view of the lower portion of lower extensible pipe 12 and baseplate 37. Materials used for baseplate 37 should be selected e.g. wood, with care given to the proper dimensioning of baseplate 37 and to the weight and weight distribution of the baseplate. One workable configuration is for baseplate 37 to be made square with the length of each edge being between 9" and 10" but which can also be 12" or up to 17". This size will permit the batting tee to topple when struck by a bat hard enough to impart sufficient angular momentum to cause the tee to topple, yet will result in the tee rocking but not toppling when struck by a bat with somewhat less force. While it is possible to ensure against nearly all toppling by using a base plate of sufficiently large dimensions, there is a more significant drawback in the fact that such a configuration places undue stresses upon the joint between lower extensible pipe 12 and baseplate 37. Lower extensible pipe 12 may be rigidly attached to base 39 with a screw and thread interface, a weld, or some other suitable rigid attachment. Base 39 is attached baseplate 37 with baseplate screws 38 as an economical and efficient fastening assembly. Upon encountering sufficient stresses, if the batting tee is not designed to topple, baseplate screws 38 may dethread or rip loose from baseplate 37, leaving the batting tee useless until it has been repaired or replaced. As it is more economical of time and money to pick up a tee than has been knocked over than it is to repair or replace a tee, the selection of a baseplate of proper dimensions is an important factor.

FIG. 12 depicts a cutaway view of the lower extremity of a middle extensible having a sleeve 40 that is held within lower extensible pipe 12. The sleeve 40 fits snugly around middle extensible pipe 12 and is retained within lower extensible pipe 12. The sleeve will resist wobbling of middle extensible pipe 15 by reducing the distance that the lower extremity of middle extensible pipe 15 can move within the lower extensible pipe 12. The sleeve also serves the function of ensuring that upper pipe 15 cannot be accidentally withdrawn from the lower extensible pipe while the compression fitting is installed at the upper end of lower extensible pipe.

Although the present invention has been particularly shown and described with reference to a preferred embodiment, it will be understood by those skilled in the art that various changes in form and detail may be made without departing from the spirit and scope of the invention.

What is claimed is:

1. A durable batting tee constructed from a combination of commercially available parts, said combination comprising:

A baseplate, a lower vertical member, an upper vertical member, and a flexible ball holder;

said baseplate being a quadrilateral, each side being no longer than approximately 12";

said baseplate being rigidly attached to the lower extremity of said lower vertical member, said lower vertical member being hollow and having an inner diameter slightly larger than the outer diameter of said upper vertical member;

the upper portion of said lower vertical member slidably receiving the lower portion of said upper vertical member, the uppermost extremity of said lower vertical member being attached to a compression nut fitting;

the lower portion of said upper vertical member having a sleeve at its lower extremity, the outer diameter of said sleeve being slightly smaller than said inner diameter of said lower vertical member;

said compression nut fitting having a compression nut and a compression washer, said compression nut and washer being circumferentially disposed about said lower portion of said upper vertical member and being tightenable about said lower portion of said upper vertical member when said compression nut is tightened such that said upper vertical member can slide within said lower vertical member with a minimum of friction when said compression nut is loosened, and sliding is retarded when said friction is increased by tightening said compression nut;

the upper extremity of said upper vertical member being attached to a flexible frustoconical ball holder, said ball holder being formed of a sheet of flexible material that is rolled into a frustoconical shape, said frustoconical ball holder having a longitudinal axis of approximately 6" to 8", a lower inner diameter that is slightly larger than the said outer diameter of said upper vertical member, and having an upper diameter that is approximately 1½" to 3";

said flexible material forming the lower portion of said frustoconical ball holder being wrapped around said upper extremity of said upper vertical member;

said flexible sheet being maintained in a frustoconical shape by a flexible strand piercing all layers of said rolled flexible material forming a frustoconical surface, said flexible strand piercing said frustoconical surface in a plurality of punctures longitudinally spaced near the outermost longitudinal edge of said rolled flexible material, said flexible strand being secured at a length no more than ½" longer than the longest distance between said punctures;

Said upper extremity of said upper vertical member terminating in a curved surface such that, said flexible frustoconical ball holder, upon being struck with a bat near said lower portion of said frustoconical ball holder, will bend against and over said curved surface and will not encounter any rigid sharp edge that would lacerate said flexible material.

2. The combination of claim 1 in which said lower portion of said frustoconical ball holder is attached to said upper extremity of said upper vertical member with flexible adhesive tape, said tape being circumferentially disposed around said lower portion of said frustoconical ball holder and said upper extremity of said upper vertical member, said flexible adhesive tape being covered with a flexible resilient sheath extending approximately 1" below and 1" to 2" above the lowermost portion of said frustoconical ball holder, such that, upon being struck by a bat, said flexible, resilient sheath will protect said flexible adhesive tape from tearing and breakage.

3. The batting tee of claim 2 in which said upper and lower vertical members are rigid, said baseplate is made of wood, and said lower vertical member is attached to said baseplate with threaded screws.

4. The batting tee of claim 2 in which said curved surface of said upper vertical member is resilient, and said lower compression nut has a slip resistant surface such that said lower compression nut may be tightened and loosed by hand when said surface has been exposed to perspiration or moisture.

5. A durable batting tee constructed from a combination of commercially available parts, said combination comprising:

A baseplate, a lower vertical member, a middle vertical member, an upper vertical member, and a flexible ball holder;

said baseplate being flat and having a maximum dimension of 17";

said baseplate being rigidly attached to the lower extremity of said lower vertical member, said lower vertical member being hollow and having an inner diameter slightly larger than the outer diameter of said middle vertical member, and said middle vertical member being hollow and having an inner diameter slightly larger than the outer diameter of said upper vertical member;

the lower portion of said upper vertical member having a sleeve at its lower extremity, the outer diameter of said sleeve being slightly smaller than said inner diameter of said lower vertical member;

the upper portion of said lower vertical member slidably receiving the lower portion of said middle vertical member, the uppermost extremity of said lower vertical member being attached to a lower compression nut fitting;

said lower compression nut fitting having a lower compression nut and a lower compression washer, said lower compression nut and washer being circumferentially disposed about said lower portion of said middle vertical member and being tightenable about said lower portion of said middle vertical member when said lower compression nut is tightened such that said middle vertical member can slide within said lower vertical member with a minimum of friction when said lower compression nut is loosened, and said friction is increased to retard sliding when said lower compression nut is tightened;

the upper portion of said middle vertical member slidably receiving the lower portion of said upper vertical member, the uppermost extremity of said middle vertical member being attached to an upper compression nut fitting;

said upper compression nut fitting having an upper compression nut and an upper compression washer, said upper compression nut and washer being circumferentially disposed about said upper vertical member and being tightenable about said lower portion of said upper vertical member when said upper compression nut is tightened such that said upper vertical member can slide within said middle vertical member with a minimum of friction when said upper compression nut is loosened, and said friction is increased to retard sliding when said upper compression nut is tightened;

The upper extremity of said upper vertical member being attached to an inverted flexible frustoconical ball holder, said ball holder being formed of a sheet of flexible material that is rolled into a frustoconical shape, said frustoconical ball holder having a longitudinal axis of approximately 6" to 8", a lower inner diameter that is slightly larger than the said outer diameter of said upper vertical member, and having an upper diameter that is approximately 1½" to 3", said flexible material forming the lower portion of said frustoconical ball holder being wrapped around said upper extremity of said upper vertical member;

said flexible sheet being maintained in a frustoconical shape by a flexible strand piercing all layers of said rolled flexible material forming a frustoconical surface, said flexible strand piercing said frustoconical surface in a plurality of punctures longitudinally spaced near the outermost longitudinal edge of said rolled flexible material and being secured at a length approximately ½" greater than the greatest distance between the farthest punctures;

Said upper extremity of said upper vertical member terminating in a curved surface such that, said flexible frustoconical ball holder, upon being struck with a bat near said lower portion of said frustoconical ball holder, will bend against and over said curved surface and will not encounter any rigid sharp edge that would lacerate said flexible material.

6. The batting tee of claim 5 in which said lower portion of said frustoconical ball holder is attached to said upper extremity of said upper vertical member with flexible adhesive tape, said tape being circumferentially wrapped around said lower portion of said frustoconical ball holder and said upper extremity of said upper vertical member, said flexible adhesive tape being covered with a flexible resilient sheath extending approximately 1" below and 1" to 2" above the lowermost portion of said frustoconical ball holder, such that, upon being struck by a bat, said flexible, resilient sheath will protect said flexible adhesive tape from tearing and breakage.

7. The batting tee of claim 6 in which said upper and lower vertical members are rigid, said baseplate is made of wood, and said lower vertical member is attached to said baseplate with threaded screws.

8. The batting tee of claim 6 in which said lower compression nut has a slip resistant surface such that said lower compression nut may be tightened and loosed by hand when said surface has been exposed to perspiration or moisture; and said curved surface of said upper vertical member is resilient.

* * * * *